United States Patent [19]

Spransy

[11] 4,231,480

[45] Nov. 4, 1980

[54] THREADED BOTTLE LID

[75] Inventor: George B. Spransy, Oconomowoc, Wis.

[73] Assignee: Anspack, Inc., Gurnee, Ill.

[21] Appl. No.: 538

[22] Filed: Jan. 2, 1979

[51] Int. Cl.[3] ..... B65D 41/04

[52] U.S. Cl. ..... 215/329; 215/DIG. 1

[58] Field of Search ..... 215/329, 330, DIG. 1; 220/289, 288; 85/DIG. 2, 32 R, 46; 151/7, 22

[56] References Cited

U.S. PATENT DOCUMENTS

| | | | |
|---|---|---|---|
| 3,074,579 | 1/1963 | Miller | 215/DIG. 1 |
| 3,640,416 | 2/1972 | Temple | 215/329 |

FOREIGN PATENT DOCUMENTS

| | | | |
|---|---|---|---|
| 1482569 | 6/1969 | Fed. Rep. of Germany | 215/329 |
| 1082440 | 9/1967 | United Kingdom | 215/329 |

*Primary Examiner*—Donald F. Norton

*Attorney, Agent, or Firm*—Andrus, Sceales, Starke & Sawall

[57] ABSTRACT

A lid for closing a wide mouth bottle has a sealing disc with a depending peripheral skirt. The skirt has an internal helical thread which takes the cross-sectional form of an elongated trapezoid tilted toward the sealing disc. The thread is formed of a flexible material for being deflected away from the disc and wedged against the neck of the bottle by the threads on the neck as the lid is tightened on the bottle.

11 Claims, 5 Drawing Figures

THREADED BOTTLE LID

BACKGROUND OF THE INVENTION

1. Field of the Invention

The present invention relates to a threaded cap for bottles and jars removably attached to the bottle by relative rotation.

2. Description of the Prior Art

Wide mouth bottles and jars of glass or plastic find widespread use for a variety of products due to the ease with which access to the contents may be gained and for other reasons.

Obtaining proper closure of such containers has presented problems due to the large dimensions of the opening. A number of different types of closures have been utilized. Multi-part closures, such as those commonly used for preserving jars, function adequately but are complex, expensive, and usually suited only for limited applications. For these reasons, single piece plastic or metal screw caps have come into most widespread commercial use. However, at present, such lids suffer several shortcomings.

One such shortcoming is a loosening of the lid on the jar termed "popping off". Popping off typically occurs because the necks of the wide mouth jars are often not truly round but tend to be somewhat oval. The lid thus contacts the jar at two diametrically opposed locations, while at locations 90° from the contact points, a rather loose engagement is obtained. This loose engagement permitted the lid thread to ride over the jar thread and the lid to pop off. Wide helical thread forms of large pitch which complete only approximately a single revolution of engagement between the jar neck and the lid contributed to this failing, as well as to a tendency to stripping of the threaded cap when the cap is applied.

Clearances between the lid and the jar threads could be reduced to lessen popping off and to enhance the seal provided by the cap. However, reduced clearances increased the torque required to secure the lid and often prevented use of automatic capping machinery.

Earlier lids were also subject to "backing off" in which the lid tended to unscrew over a period of time as a result of plastic creep in the lid material or jar material.

SUMMARY OF THE PRESENT INVENTION

The present invention reduces or eliminates the problems of popping off, stripping, and backing off heretofore associated with wide mouth bottle lids.

The lid of the present invention has a sealing disc abuttable with the top of the bottle neck when the bottle is closed. A peripheral skirt depends from the disc with a helical thread form on the interior wall engagable with the thread on the bottle. The cross sectional configuration of the thread form is that of an elongated trapezoid and the thread form is tilted toward the sealing disc. The thread form is flexible.

When the lid is threaded on the bottle, the trapezoidal thread form is deflected away from the disc by engagement with the thread on the bottle and wedges against the bottle at the roof of the bottle thread, preventing popping off. It also eliminates backing off since the jamming action drives the tip of the lid thread to mate with the minor irregularities inevitably appearing in the root of the bottle thread resisting rotation in the loosening direction. The elongated trapezoidal configuration of the lid thread insures that the helix has at least one full turn of engagement with the bottle, thereby lessening the likelihood of stripping. Where the lids are made of plastic, the thin threads prevents any indentation from appearing on the exterior of the cap, due to shrinkage, thereby providing a pleasing cosmetic effect to the cap. The deflectability of the thead insures tha both an adequate clearance for automatic capping equipment may be provided between the thread and the neck while at the same time providing zero clearance between cap and bottle when the cap is secured on the bottle insuring that no popping off or backing off will occur.

Grooves may be provided in the cap adjacent the base of the trapezoidal thread form for increasing its effective length and controlling its deflection properties.

DETAILED DESCRIPTION OF THE PREFERRED EMBODIMENT

Figure 1:
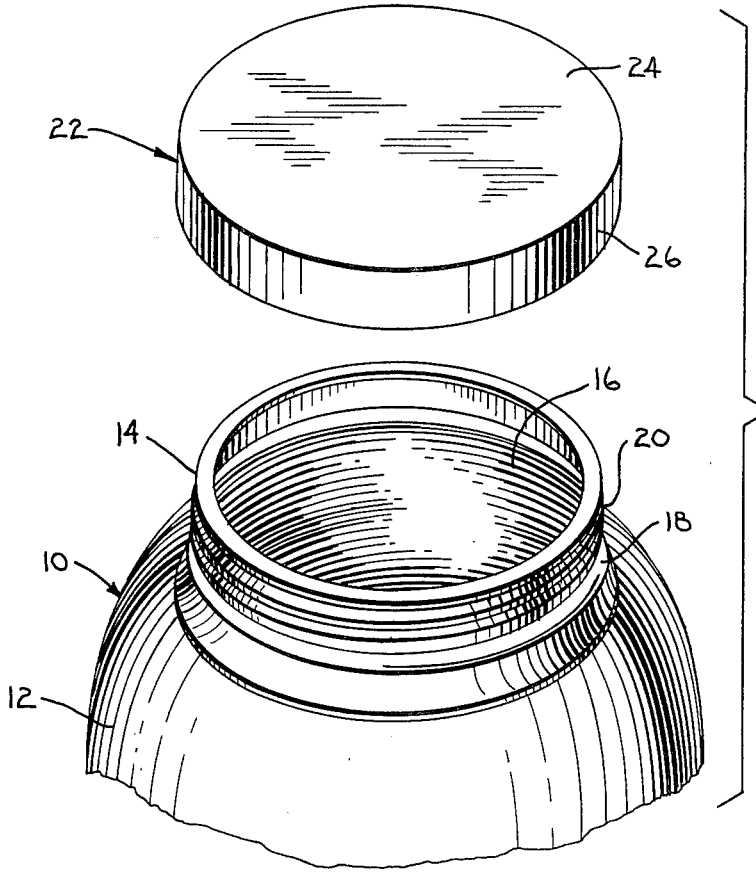
FIG. 1 is a perspective view of a wide mouth jar and the closure of the present invention.

FIG. 1 shows wide mouth jar 10 of conventional construction. Jar 10 includes container portion 12 terminating in neck 14 having mouth 16. Neck 14 has shoulder 18 and helical thread 20 on the exterior thereof. The form and dimension of thread 20 is typically standardized by some industry or trade convention, such as the Plastic Bottle Division of the Society of the Plastics Industry or Glass Container Manufacturers Institute (G.C.M.I.).

Cap 22, which is preferably formed of a plastic such as polyethylene, or other flexible material, includes sealing disc 24 which spans mouth 16 of jar 10. Skirt 26 depends from the periphery of disc 24 to be generally parallel to neck 14. As shown in the cross-sectional views of FIGS. 2, 3, and 4, the inner wall of skirt 26 contains a helical thread 28 which engages thread 20 on neck 14 when cap 22 is screwed on jar 10 to close the jar.

Figure 2:
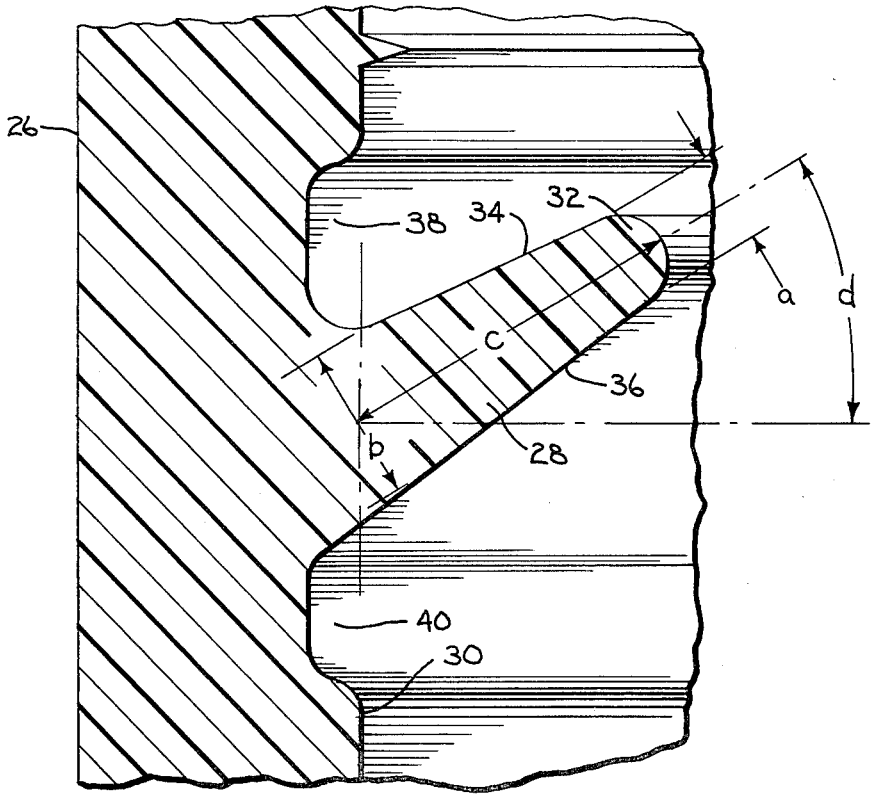
FIG. 2 is a cross-sectional view of the skirt portion of the closure on a greatly enlarged scale showing the basic thread form employed in the closure.

The form of thread 28 is shown in greater detail in the enlarged cross-sectional view of FIG. 2. Thread 28 extends from inner wall 30 of skirt 26. Thread 28 is generally trapezoidal in cross-sectional configuration having a base contiguous with inner wall 30 and narrowing towards the exposed end or tip 32. The side walls 34 and 36 converge in the direction of tip 32.

The width "a" of tip 32, when taken normal to the axis of thread 28, is approximately one half the width "b" of the base at the point of intersection of the axis with the plane of the inner wall 30. The length "c" of thread 28 may be approximately 4 to 5 times the dimension "a".

Figure 3:
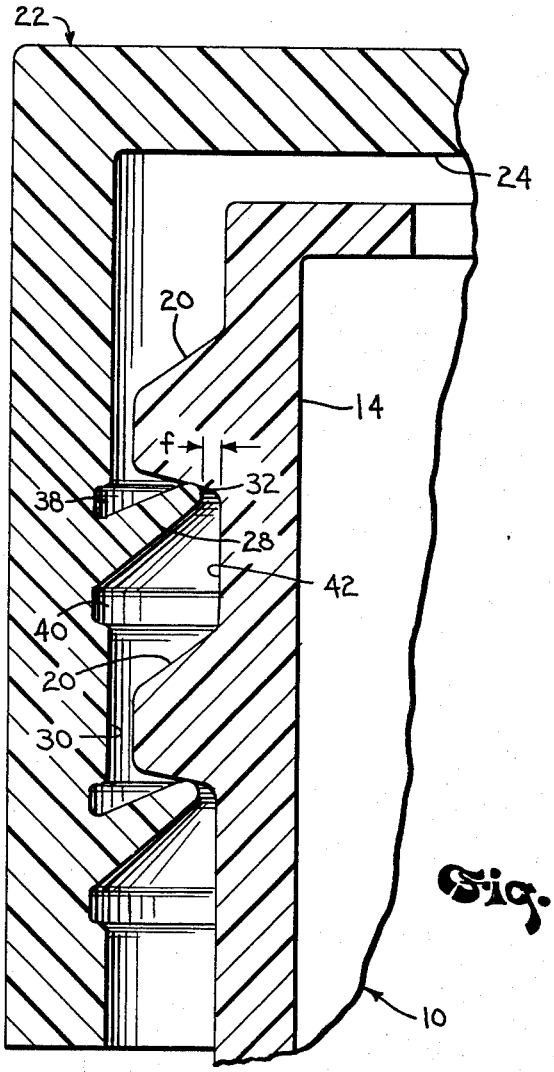
FIGS. 3 and 4 are cross-sectional views showing closing of the jar by the closure of the present invention.

Thread 28 is tilted in the direction of sealing disc 24, as shown in FIGS. 2 and 3 so that sides 34 and 36 lie obliquely with respect to inner wall 30. While the amount of this tilt may vary between 15° and 45°, a tilt "d" of 30° from a normal to inner wall 30 of skirt 26 has been found to enhance the unique results obtained by the lid of the present invention.

Grooves 38 and 40 in inner wall 30 are provided on either side of thread 28. These grooves increase the effective length of thread 28 and control the position of the point about which thread 28 deflects and the flexibility of the thread.

Figure 4:
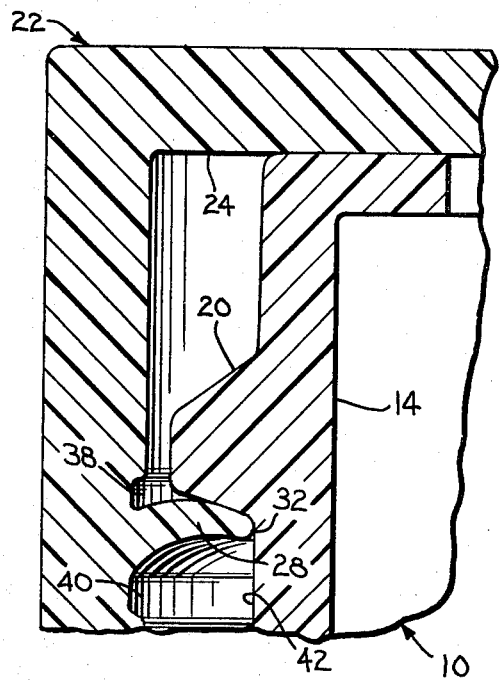

The closure operation of lid 22 is shown in FIGS. 3 and 4. Lid 22 is placed on neck 14 of jar 10. Lid 22 is rotated to engage helical thread 28 on lid 22 with helical thread 20 on neck 14. The engagement of threads 20 and 28 is shown in FIG. 3. Thread 28 is sized so that a clearance "f" shown in FIG. 3 exists between tip 32 of thread 28 and the outer wall 42 of neck 14. This insures that lid 22 may be mechanically applied, as by a capping machine, to neck 14. The tip 32 of thread 28 typically contacts the underside of thread 20 in the initial stages of applying the lid.

When sealing disc 24 is brought into contact with the open end of neck 14 and the torque tightening lid 22 on neck 14 increases, thread 20 begins to exert a downward pressure on tip 32 of thread 28. This causes thread 28 to deflect downward along its length, rotating about a pivot point located in the area of the base of trapezoidal thread form 28, as shown in FIG. 4. In so doing, tip 32 moves toward and into contact with the root of thread 20 and outer wall 42 of neck 14 until it wedges or jams against neck 14 at the root of thread 20 eliminating clearance between lid 22 and bottle 10. This wedging action, extended circumferentially about lid 22, secures the lid to the bottle and prevents any popping off, and the friction between the elements prevents any loosening of the lid. Tip 32 is driven into any irregularities present at the root of thread 20, resisting rotation in the off direction and further serving to secure lid 22 on bottle 10.

When lid 22 is unscrewed, thread 28 tends to resume its original shape as the lid loosens on bottle 10.

Figure 5:
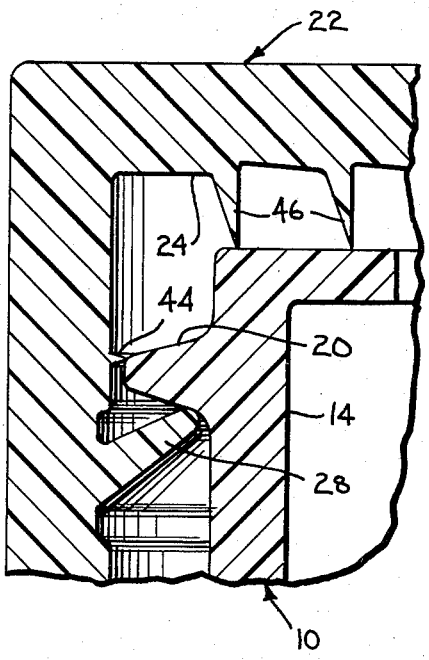
FIG. 5 is a cross-sectional view of a modified emgodiment of the closure of the present invention.

FIG. 5 shows a modified embodiment of the invention in which the features of the present invention are further enhanced. A helical projection 44 is located above thread 28 in the direction toward sealing disc 24 so as to abut the crown of thread 20 when lid 22 is tightened on neck 14. This projection centers lid 22 on neck 14 during the capping operation. This insures maximum utilization of the available contact between thread 28 on lid 22 and thread 20 on neck 14. Projection 44 may be triangular in cross-configuration, as shown in FIG. 5. Also, a plurality of circular projections 46 on the inner surface of sealing disc 24, which may also be flexible, help obtain a tight seal with the end of neck 14 through their deflection when the lid is tightened on the jar.

Various modes of carrying out the invention are contemplated as being within the scope of the following claims particularly pointing out and distinctly claiming the subject matter which is regarded as the invention.

I claim:

1. A lid for closing the end of a wide mouth container having an exterior helical thread of standard design on the exterior of the mouth, said cap having a sealing disc abuttable with the end of the mouth when said cap is in a closure position, said cap having a skirt depending from the periphery of said disc and lying generally parallel to the exterior of the mouth for surrounding same, said skirt having a helical thread form projecting from the inner wall thereof engagable with the thread on the container mouth for obtaining axial movement between said cap and container responsive to relative rotation therebetween, said thread form having a generally inwardly elongated trapezoidal cross-sectional configuration with a base contiguous with said inner wall, a tip extending inwardly to a predetermined clearance with the container, and a pair of side walls converging in the direction of said tip and lying obliquely with respect to said inner wall, said thread form being tilted in the direction of said disc and formed of a flexible material, said inward extension of said thread form being sufficient to cause said thread form to be deflected away from said disc by engagement with the container mouth thread into wedging contact with the root of the container mouth thread when said lid is threaded on the container.

2. The lid according to claim 1 further including grooves in said inner wall of said skirt adjacent the base of said trapezoidal thread form.

3. The lid according to claim 1 wherein said thread form is tilted in the direction of said disc by an angle between 15° and 45° with respect to the normal of said inner wall of said skirt.

4. The lid according to claim 1 wherein said thread form is tilted by an angle of 30° with respect to the normal to said inner wall.

5. The lid according to claim 1 wherein said thread form has a central axis and wherein the width of said tip normal to said central axis is approximately one half the width of the base normal to the axis at the point where the central axis intersects the plane of said inner wall.

6. The lid according to claim 1 wherein said thread form has a central axis and wherein the length of said thread form along said central axis from said tip to the intersection of said axis with the plane of the inner wall is four to five times the width of said tip.

7. The lid according to claim 1 further including a helical projection on the inner wall of said skirt spaced from said thread form in a direction towards said disc, said projection being so positioned on said inner wall as to contact the exterior helical thread of the container when said lid is placed on the container.

8. The lid according to claim 7 wherein said projection is triangular in cross-sectional configuration.

9. The lid according to claim 1 further including at least one circular projection on said disc for engaging the end of said container.

10. The lid according to claim 9 including a pair of circular projections on said disc for engaging the end of said container.

11. The lid according to claim 1 wherein said lid is formed of a flexible material.

* * * * *